US005261762A

United States Patent [19]

Yamaguchi

[11] Patent Number: 5,261,762

[45] Date of Patent: Nov. 16, 1993

[54] TAMPING SHOE OF A VIBRATION RAMMER

[76] Inventor: Hitoshi Yamaguchi, 2-2-203, Isobe 6-chome, Chiba-shi, Chiba, Japan

[21] Appl. No.: 899,496

[22] Filed: Jun. 16, 1992

[30] Foreign Application Priority Data

Jun. 17, 1991 [JP] Japan ..... 3-45413[U]

[51] Int. Cl.[5] ..... E01C 19/00

[52] U.S. Cl. ..... 404/133.05; 404/117

[58] Field of Search ..... 404/133.05, 117

[56] References Cited

U.S. PATENT DOCUMENTS 2,771,012 11/1956 Jackson .

4,382,715 5/1983 Vural et al. ..... 404/133.05

*Primary Examiner*—Thuy M. Bui

*Attorney, Agent, or Firm*—Thomas R. Morrison

[57] ABSTRACT

A tamping shoe for a vibration rammer has a plurality of through holes communicating between an under surface and an upper surface. The through holes permit the escape of air trapped between the under surface and a surface being tamped, and thereby reduce the amount and pressure of air compressed under the tamping shoe. This reduces noise pollution produced during tamping. In a preferred embodiment, the through holes are tapered outward in the direction of air flow. Air passing through a through hole in a mount is released through a further through hole bored through a wall of the mount.

4 Claims, 2 Drawing Sheets

TAMPING SHOE OF A VIBRATION RAMMER

BACKGROUND OF THE INVENTION

1. Field of the Invention

The present invention relates to a tamping shoe for a vibration rammer, more particularly, a tamping shoe for a rammer for flattening and tamping soil and gravel on a road or other surface.

2. Description of the Prior Art

As described, for example, in Japanese Utility Model Publication No. 20645/1985, conventional vibration rammers have a tamping shoe attached to the bottom of the rammer body so that vibration of the excitation mechanism of the rammer is conveyed to the tamping shoe, thus permitting it to roll and tamp the ground.

Conventional tamping shoes have a generally rectangular, flat shape, which produces impulse sounds during rolling compaction of the ground because of the compression of air trapped between the tamping shoes and the surface being tamped. Such impulse sounds cause noise pollution, resulting in the restriction of nighttime work.

OBJECTS AND SUMMARY OF THE INVENTION

It is an object of the present invention to provide a tamping shoe of a vibration rammer which overcomes the drawbacks of the prior art.

It is a further object of the present invention to provide a tamping shoe of a vibration rammer which is capable of reducing the compression of air under the tamping shoe, thereby reducing impulse sounds caused by such compression of air.

A tamping shoe of a vibration rammer according to the present invention is attached to the bottom of a rammer in order to transmit vibration from an excitation mechanism to a surface to be tamped. The tamping shoe has a generally rectangular flat shape with through holes vertically bored through. The through holes preferably taper outward.

When a tamping shoe of a vibration rammer according to the present invention is driven forward and backward by an excitation mechanism of the rammer to flatten and compact the surface, air is released upward through through holes so that the amount of air compressed, hence impulse sounds caused by compressed air, is reduced. Dirt and sand entering the through holes are discharged from the opening at the top of each through hole.

Briefly stated, a tamping shoe for a vibration rammer has a plurality of through holes communicating between an under surface and an upper surface. The through holes permit the escape of air trapped between the under surface and a surface being tamped, and thereby reduce the amount and pressure of air compressed under the tamping shoe. This reduces noise pollution produced during tamping. In a preferred embodiment, the through holes are tapered outward in the direction of air flow to improve the noise reduction, and to enhance the ability of dirt to escape through the through holes. Air passing through a through hole in a mount is released through a further through hole bored through a wall of the mount.

According to an embodiment of the invention, there is provided a tamping shoe for a vibration rammer comprising: a generally flat under surface on the tamping shoe adapted for contacting a surface to be tamped, an upper surface on the tamping shoe, and a plurality of through holes communicating between the under surface and the upper surface, the through holes being effective for permitting escape of air trapped between the under surface and the surface to be tamped.

The above, and other objects, features and advantages of the present invention will become apparent from the following description read in conjunction with the accompanying drawings, in which like reference numerals designate the same elements.

DETAILED DESCRIPTION OF PREFERRED EMBODIMENTS

Figure 1:
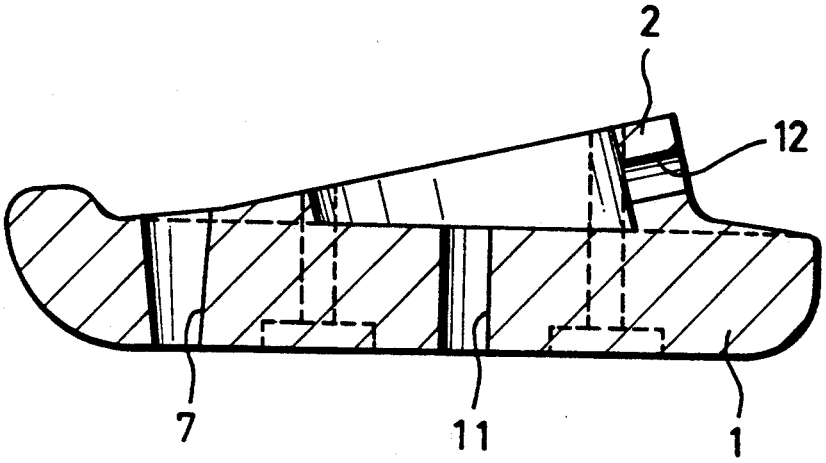
FIG. 1 is a vertical sectional view of a tamping shoe of a vibration rammer according to an embodiment of the present invention.
Figure 2:
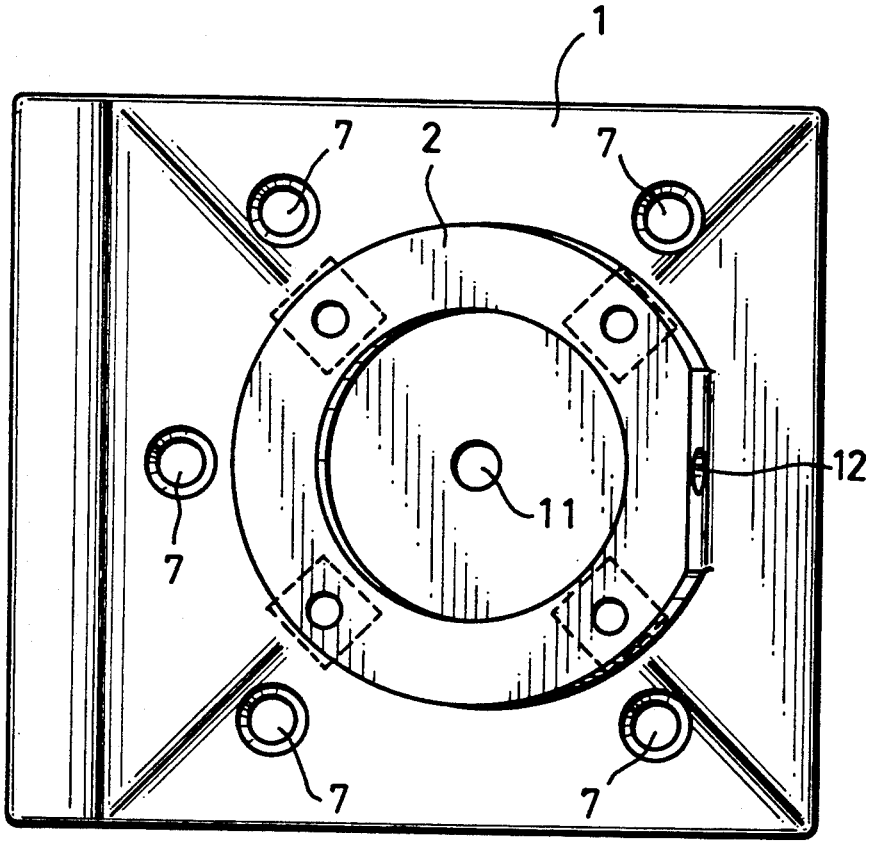
FIG. 2 is a plan view of the tamping shoe of FIG. 1.
Figure 3:
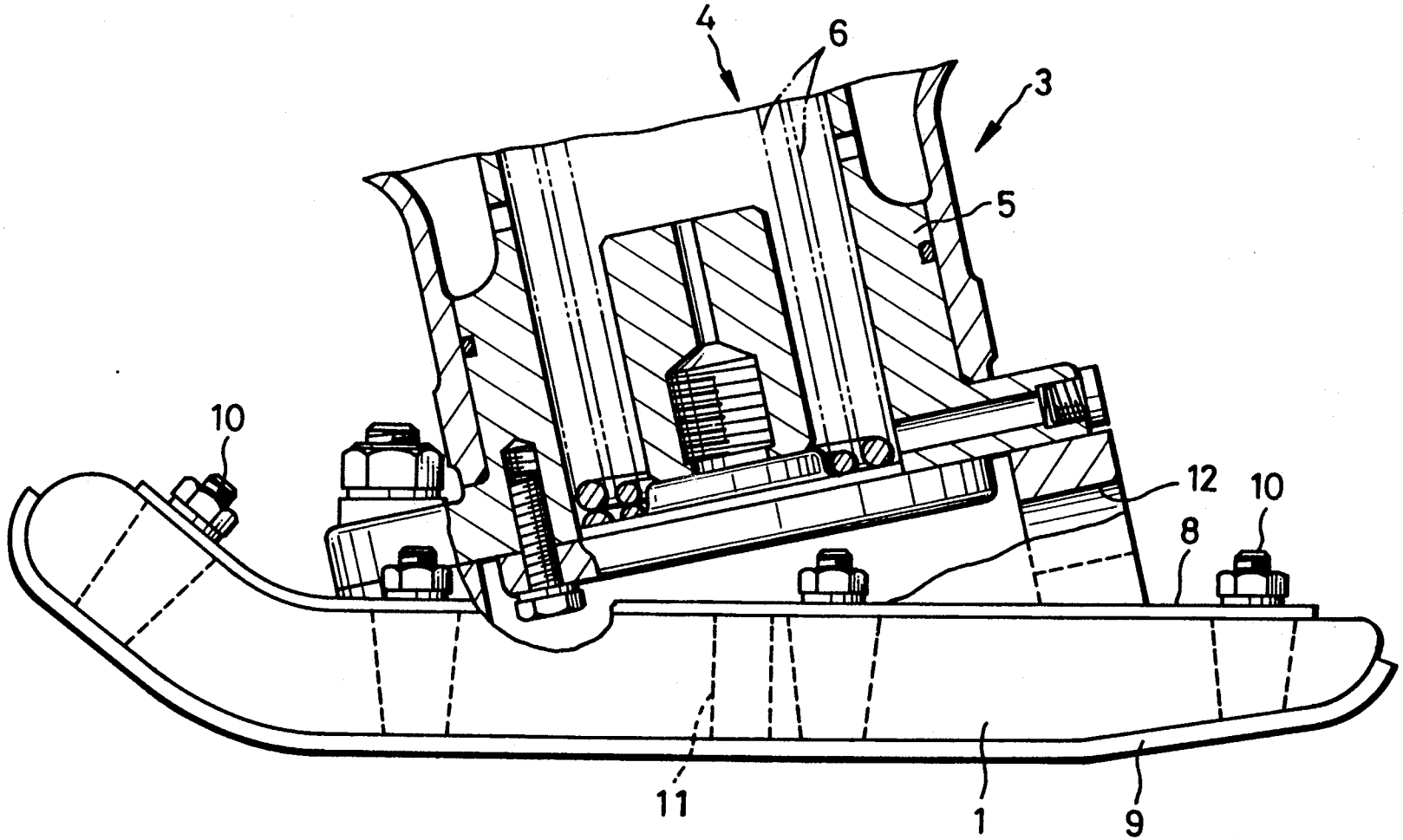
FIG. 3 is a vertical sectional view of a part of the a vibration rammer useable with the tamping shoe of FIGS. 1 and 2.

Referring to FIGS. 1–3, a tamping shoe 1 is a flat rectangular plate made of wood, steel, light alloy, rubber, urethane resin or other synthetic resin. A front part of tamping shoe 1 (to the left in the figures) is bent upward. A generally cylindrical mount 2, is formed at the center top of tamping shoe 1. An upper end of cylindrical mount 2 is inclined upward from the front to the rear end (from left to right in the figures).

A bottom of a movable cylinder 5 of an excitation mechanism 4 of a rammer body 3 is bolted into mount 2 of tamping shoe 1. A fixed cylinder (not shown in the drawings) in excitation mechanism 4 receives movable cylinder 5 in a sliding manner effective to permit movable cylinder 5 to advance and retreat therein. Coil springs 6 extend between the bottom of movable cylinder 5 the fixed cylinder. A piston and a piston rod (not shown) are disposed between the fixed cylinder of excitation mechanism 4 and movable cylinder 5.

The piston is driven to advance and retreat by a motor. The piston moves movable cylinder in one direction, and a restoring force in the opposite direction, provided by springs 6, move movable cylinder 5 in the opposite direction to produce up and down motion. Downward movement of movable cylinder 5 causes tamping shoe 1 to flatten and compact the ground surface.

A plurality of through holes 7 are bored through tamping shoe 1, from the bottom to the top thereof, outside the perimeter of mount 2. The diameter of each through through hole 7 tapers outward from bottom to top such that the upper diameter of each through hole 7 is larger than its lower diameter.

Reinforcement materials 8 and 9 may be fixed, if necessary, to the upper and lower surfaces, respectively, of tamping shoe 1 by bolts 10.

A central through hole 11 is vertically bored through shoe 1, inside the perimeter of mount 2, near the center thereof. A through hole 12 is bored through the rear of mount 2. Through hole 11 and through hole 12 communicate with an open volume in mount 2, below movable cylinder 5, whereby air communication is provided between these two through holes.

When movable cylinder 5 is driven downward by excitation mechanism 4, tamping shoe 1 is pounded against the ground surface, thus compacting and tamping the ground. As the lower surface of tamping shoe 1 contacts the surface, air trapped between tamping shoe 1 and the ground surface is compressed. A substantial part of the air escapes through through holes 7 of tamping shoe 1, thereby reducing the amount of compressed air, and reducing the pressure reached by the air that fails to pass through the through holes. As a result, impulse noise caused by compressed air is reduced.

The silencing effect is enhanced by the increasing tapered diameters of through holes 7. Air passing through through 11, located generally at the center of mount 2, passes out from mount 2 through through hole 12 at the rear part of mount 2. This avoids blocking through hole 11 by rammer body 3 covering the top of mount 2.

According to the present invention, during reciprocating drive of a tamping shoe to flatten and compact the ground surface, air that would otherwise be trapped under tamping shoe 1 passes upward through the through holes to the outside of the machine. As a result, the amount of compressed air trapped between tamping shoe 1 and a surface being tamped is reduced substantially. As a consequence, impulse noise caused by compressed air under tamping shoe 1, is reduced. This reduction in impulse noise makes it possible to use a vibration rammer at night without disturbing the neighborhood.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A tamping shoe for a vibration rammer comprising a generally flat under surface on said tamping shoe adapted for contacting a surface to be tamped, an upper surface on said tamping shoe, and a plurality of through holes communicating said under surface and said upper surface, said through holes tapering outwardly in a direction from said under surface to said upper surface and providing an escape path for air trapped between said under surface and said surface to be tamped and for particles of material of the surface being tamped to pass through to the said upper surface.

2. Apparatus according to claim 1, wherein said tamping shoe is generally rectangular.

3. A tamping shoe for a vibration rammer comprising a generally flat under surface on said tamping shoe adapted for contacting a surface to be tamped, an upper surface on said tamping shoe, and a plurality of through holes communicating between said under surface and said upper surface, said through holes being effective for permitting escape of air trapped between said under surface and said surface to be tamped, said tamping shoe further including a mount generally centered in said upper surface, said mount enclosing a center portion of said upper surface, at least one of said through holes extending from said under surface to said center portion, and means for communicating said center portion to a location outside said mount.

4. A tamping shoe according to claim 3, wherein:

said means for communicating includes a further through hole through said mount; and said further through hole communicating with an open volume disposed above said center portion.

* * * * *